US011104132B2

(12) United States Patent
Kobayashi et al.

(10) Patent No.: US 11,104,132 B2
(45) Date of Patent: Aug. 31, 2021

(54) LIQUID DISCHARGE HEAD, HEAD MODULE, AND LIQUID DISCHARGE APPARATUS

(71) Applicant: Ricoh Company, Ltd., Tokyo (JP)

(72) Inventors: Yohsuke Kobayashi, Kanagawa (JP); Kaname Morita, Kanagawa (JP); Kenshiroh Munetomo, Kanagawa (JP); Yoshihide Niisato, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/797,724

(22) Filed: Feb. 21, 2020

(65) Prior Publication Data

US 2020/0269575 A1 Aug. 27, 2020

(30) Foreign Application Priority Data

Feb. 22, 2019 (JP) ..... JP2019-030662

(51) Int. Cl.
*B41J 2/14* (2006.01)
*B41J 2/16* (2006.01)

(52) U.S. Cl.
CPC ..... *B41J 2/1433* (2013.01); *B41J 2/1623* (2013.01); *B41J 2002/14411* (2013.01); *B41J 2202/20* (2013.01)

(58) Field of Classification Search
CPC ..... B41J 2/1623
See application file for complete search history.

(56) References Cited

U.S. PATENT DOCUMENTS 5,798,778 A 8/1998 Kimura et al.
6,312,103 B1 * 11/2001 Haluzak ..... B41J 2/14016 347/45
2002/0105567 A1 * 8/2002 Yamada ..... B41J 2/14209 347/87
2004/0189757 A1 * 9/2004 Yamada ..... B41J 2/17559 347/86
2009/0058935 A1 * 3/2009 Owaki ..... B41J 2/161 347/47

(Continued)

FOREIGN PATENT DOCUMENTS

JP 6-210859 8/1994
JP 2001-347664 12/2001

(Continued)

*Primary Examiner* — Shelby L Fidler
(74) *Attorney, Agent, or Firm* — Xsensus LLP

(57) ABSTRACT

A liquid discharge head includes a nozzle substrate and a cover member. The nozzle substrate includes a liquid discharge surface, a plurality of nozzles, and a continuous recess. The plurality of nozzles is arranged in a nozzle arrangement area on the liquid discharge surface and configured to discharge liquid from the liquid discharge surface. The continuous recess surrounds the nozzle arrangement area on the liquid discharge surface. The cover member is joined to the nozzle substrate with the nozzle arrangement area being exposed. The nozzle arrangement area has a liquid repellency with respect to the liquid. An inside of the recess is lyophilic to the liquid and is provided with an adhesive, and the nozzle substrate is joined to the cover member with the adhesive.

10 Claims, 15 Drawing Sheets

(56) References Cited

U.S. PATENT DOCUMENTS

2009/0303289 A1* 12/2009 Tagawa ..... B41J 2/1629 347/47
2012/0069101 A1 3/2012 Kato et al.
2012/0160925 A1 6/2012 Hoisington et al.
2012/0206540 A1 8/2012 Kato et al.
2012/0206545 A1 8/2012 Kato et al.
2012/0212545 A1 8/2012 Mizukami et al.
2012/0229573 A1 9/2012 Mizukami et al.
2012/0236083 A1 9/2012 Mizukami et al.
2012/0320131 A1 12/2012 Kato et al.
2013/0021412 A1 1/2013 Nishimura et al.
2013/0050354 A1 2/2013 Kato et al.
2013/0070021 A1 3/2013 Nishimura et al.
2014/0285577 A1* 9/2014 Nagaoka ..... B41J 2/1631 347/47
2014/0307028 A1* 10/2014 Omura ..... B41J 2/1433 347/44
2015/0171307 A1 6/2015 Masuda et al.
2015/0283813 A1* 10/2015 Oya ..... B41J 2/1631 347/47
2016/0001556 A1 1/2016 Masuda et al.
2017/0001441 A1 1/2017 Kato
2017/0100934 A1 4/2017 Masuda et al.
2017/0120599 A1* 5/2017 Nawano ..... B41J 2/1623
2017/0151782 A1 6/2017 Takahashi et al.
2018/0086065 A1* 3/2018 Yamazaki ..... B41J 2/14209
2019/0270310 A1 9/2019 Masuda et al.
2019/0275793 A1 9/2019 Kato
2019/0275796 A1 9/2019 Miwa
2019/0275797 A1 9/2019 Kato

FOREIGN PATENT DOCUMENTS

JP 2006-256029 9/2006
JP 2007-331127 12/2007
JP 2012-101365 5/2012

* cited by examiner

LIQUID DISCHARGE HEAD, HEAD MODULE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-030662, filed on Feb. 22, 2019, in the Japan Patent Office, the entire disclosure of which is incorporated by reference herein.

BACKGROUND

Technical Field

Aspects of the present disclosure relate to a liquid discharge head, a head module, and a liquid discharge apparatus.

Related Art

In a liquid discharge head, a cover member (also referred to as "cover") is provided on a nozzle substrate including a nozzle for securing liquid repellency on an outer periphery of the liquid discharge head and rigidity thereof, and protecting a surface and an edge of the nozzle substrate (also referred to as "liquid discharging member"), and protecting an electric part against ink. In a case where a plurality of heads is made a line to make an elongated head, an x, y, z reference position is provided on the cover member.

However, since such a cover member is merely fitted into the liquid discharge head, ink intrudes a clearance between the nozzle substrate and the cover member and adheres to the electric part of the liquid discharge head, so that there has been a disadvantage that the electric part is sometimes broken. In the above-described method, the cover member and the nozzle substrate are not completely secured, so that there has been a disadvantage of positional shift between the cover member and the nozzle substrate.

SUMMARY

In an aspect of the present disclosure, there is provided a liquid discharge head that includes a nozzle substrate and a cover member. The nozzle substrate includes a liquid discharge surface, a plurality of nozzles, and a continuous recess. The plurality of nozzles is arranged in a nozzle arrangement area on the liquid discharge surface and configured to discharge liquid from the liquid discharge surface. The continuous recess surrounds the nozzle arrangement area on the liquid discharge surface. The cover member is joined to the nozzle substrate with the nozzle arrangement area being exposed. The nozzle arrangement area has a liquid repellency with respect to the liquid. An inside of the recess is lyophilic to the liquid and is provided with an adhesive. The nozzle substrate is joined to the cover member with the adhesive.

In another aspect of the present disclosure, there is provided a liquid discharge apparatus including the liquid discharge head.

In still another aspect of the present disclosure, there is provided a head module that includes a plurality of liquid discharge heads and a plurality of cover members. The plurality of liquid discharge heads includes a plurality of nozzle substrates, respectively. The plurality of cover members is joined to the plurality of nozzle substrates, respectively. Each of the plurality of nozzle substrates includes a liquid discharge surface, a plurality of nozzles, and a continuous recess. The plurality of nozzles is arranged in a nozzle arrangement area on the liquid discharge surface and configured to discharge liquid from the liquid discharge surface. The continuous recess surrounds the nozzle arrangement area on the liquid discharge surface. The nozzle arrangement area has a liquid repellency with respect to the liquid. An inside of the recess is lyophilic to the liquid and provided with an adhesive. Each of the plurality of cover members is joined to one of the plurality of nozzle substrates with the adhesive such that the nozzle arrangement area is exposed.

In still yet another aspect of the present disclosure, there is provided a liquid discharge apparatus including the head module.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
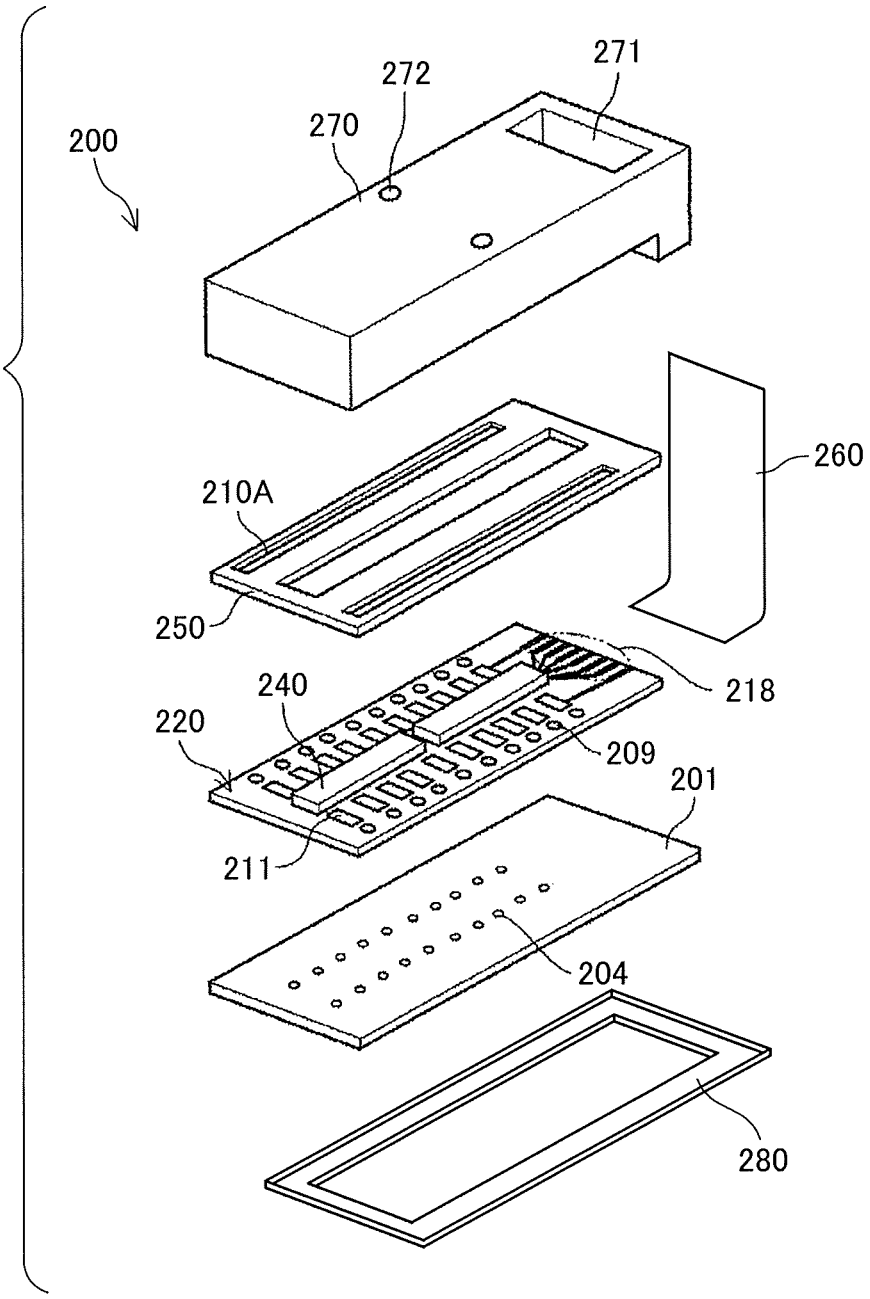
FIG. 1 is an exploded perspective view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments are described with reference to the drawings. For clarity of description, the following description and drawings are omitted or simplified as appropriate. In the drawings, components having the same configuration or function and corresponding parts are assigned with the same reference numeral, and description thereof is omitted.

An embodiment of the present disclosure has the following characteristics in securing a sealing property between a nozzle substrate and a cover member and realizing high-precision securing of a liquid discharge head. In the liquid discharge head, a recess made lyophilic is formed on an outer periphery of a discharge surface of the nozzle substrate, and the recess is made an area (margin for adhesion) for adhering to the cover member, so that the nozzle substrate is joined to the cover member with an adhesive. The embodiments of the present disclosure are hereinafter described with reference to the accompanying drawings.

Liquid Discharge Head

Figure 2:
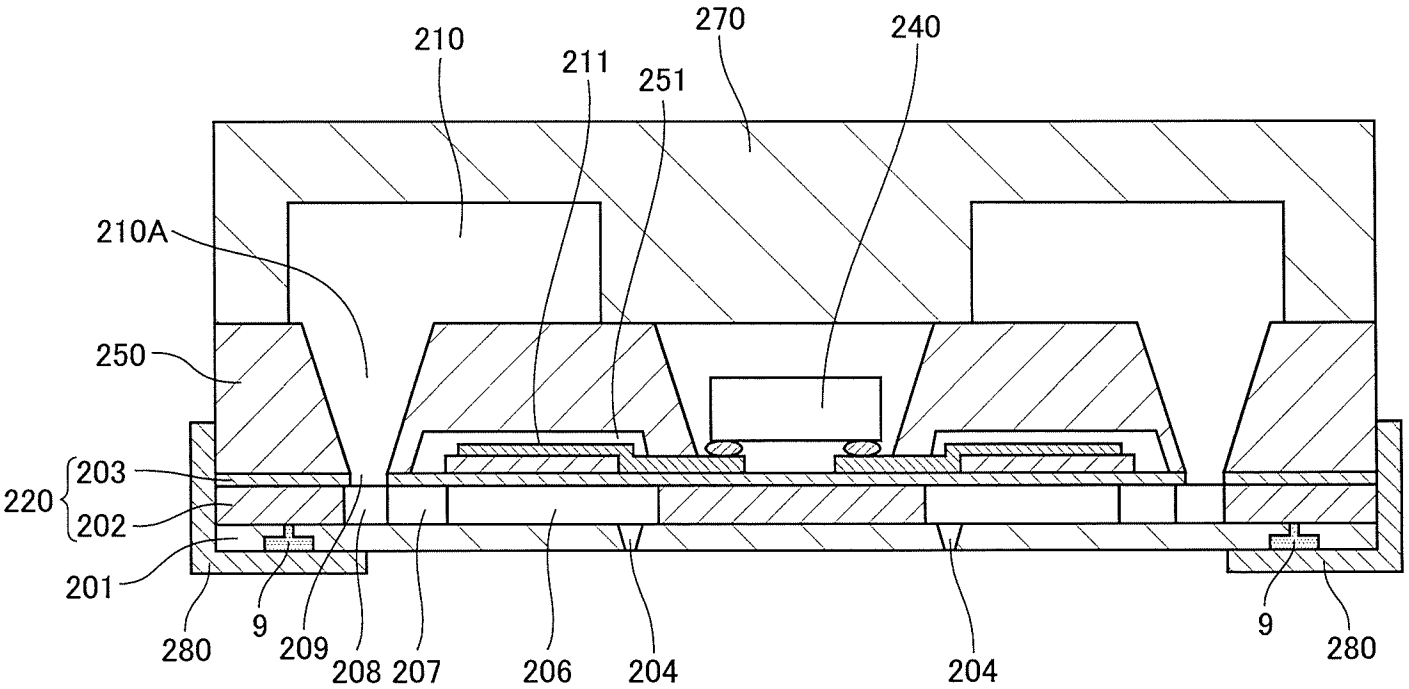
FIG. 2 is a cross-sectional view in a direction orthogonal to a nozzle array direction of the same.
Figure 3:
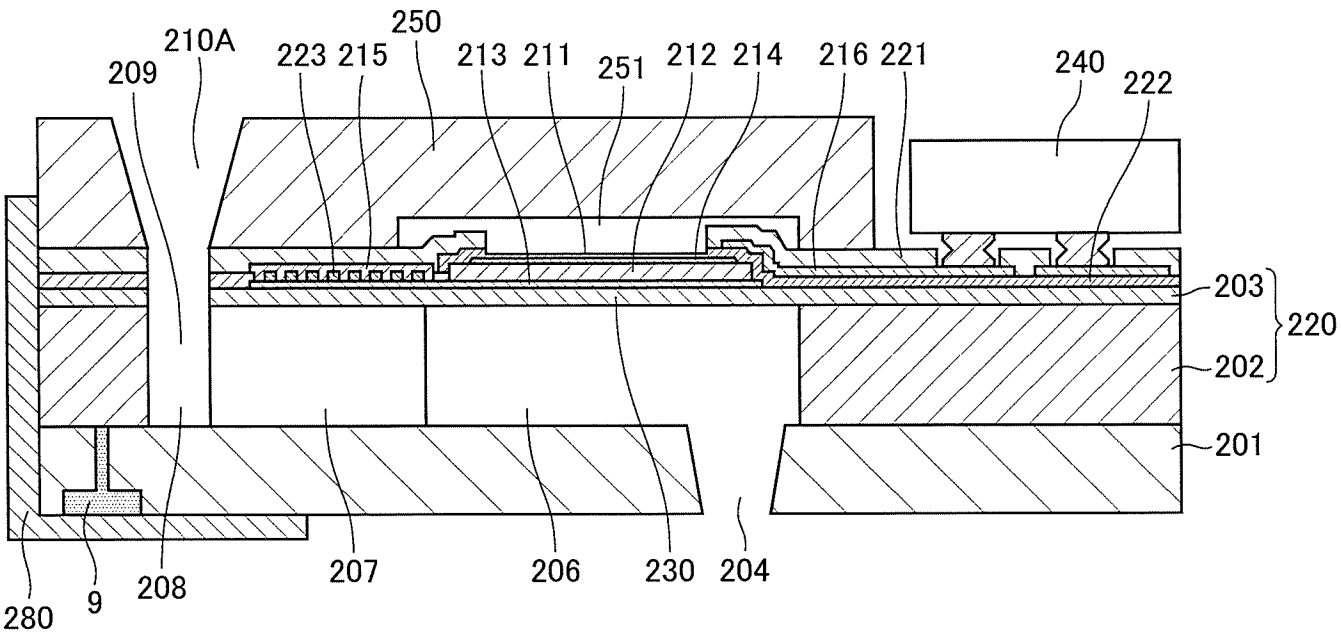
FIG. 3 is an enlarged cross-sectional view of a substantial part in FIG. 2.
Figure 4:
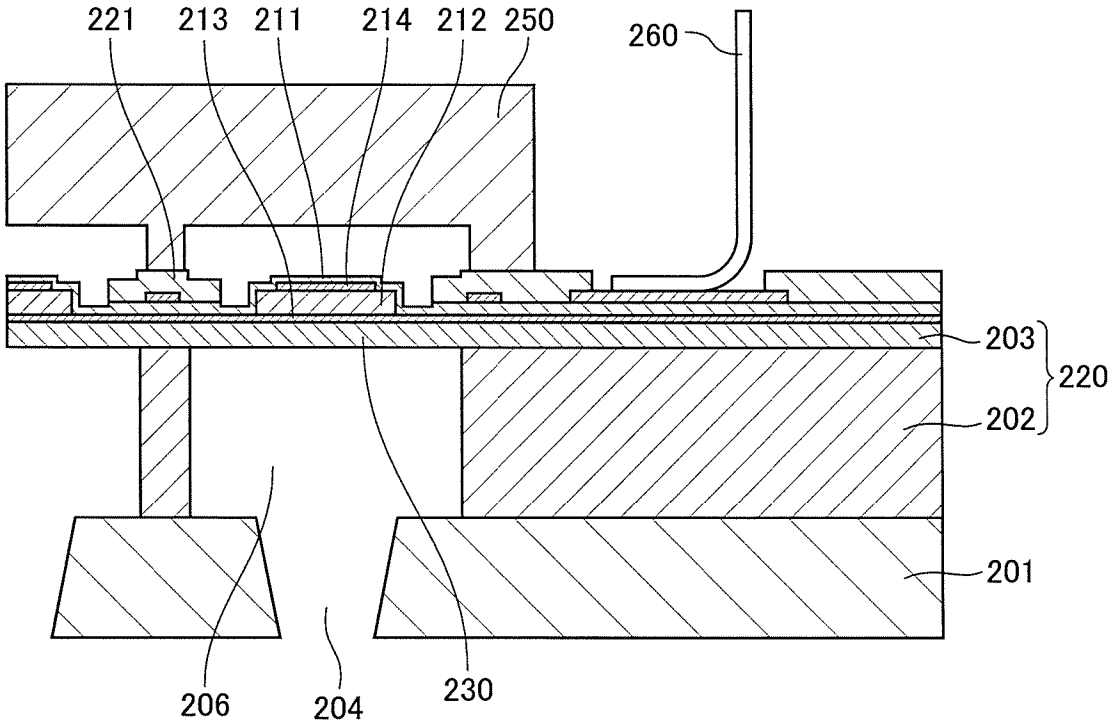
FIG. 4 is a cross-sectional view of the substantial part in the nozzle array direction of the same.

A liquid discharge head according to an embodiment of the present disclosure is described with reference to FIGS. 1 to 4. FIG. 1 is an exploded perspective view of the liquid discharge head, FIG. 2 is a cross-sectional view in a direction orthogonal to a nozzle array direction of the same, FIG. 3 is an enlarged cross-sectional view of a substantial part of FIG. 2, and FIG. 4 is a cross-sectional view of the substantial part in the nozzle array direction of the same.

A liquid discharge head (also referred to as "head") 200 includes a nozzle substrate 201, a channel substrate 202, a vibration substrate 203, a piezoelectric element 211 as a pressure generator, a holding substrate 250, a frame member 270 also serving as a common-chamber substrate, and a cover member 280.

In this embodiment, a portion formed of the channel substrate 202, the vibration substrate 203, and the piezoelectric element 211 is made an "actuator substrate 220" as an actuator member according to the present disclosure. However, this does not mean that an independent member formed as the actuator substrate 220 is joined to the nozzle substrate 201, the holding substrate 250, and the frame member 270.

The nozzle substrate 201 includes a plurality of nozzles 204 which discharges liquid formed thereon. Herein, two nozzle arrays in which the nozzles 204 are arrayed are arranged. The cover member 280 is adhered to be joined to the nozzle substrate 201 with an adhesive 9. The nozzle substrate 201 and the cover member 280 used in the liquid discharge head 200 of an embodiment are described later with reference to FIGS. 5A, 5B, 6A, and 6B.

The channel substrate 202, together with the nozzle substrate 201 and the vibration substrate 203, forms an individual liquid chamber 206 communicated with the nozzle 204, a fluid restrictor 207 communicated with the individual liquid chamber 206, and a liquid introduction unit (pathway) 208 communicated with the fluid restrictor 207.

The liquid introduction unit 208 is communicated with a common liquid chamber 210 formed of the frame member 270 via a pathway (supply port) 209 of the vibration substrate 203 and a channel 210A being a part of a common liquid chamber of the holding substrate 250. Liquid is externally supplied to the common liquid chamber 210 of the frame member 270 through a supply port 272.

The vibration substrate 203 forms a deformable vibration area 230 which forms a part of a wall surface of the individual liquid chamber 206. The piezoelectric element 211 is provided integrally with the vibration area 230 on a surface opposite to the individual liquid chamber 206 of the vibration area 230 of the vibration substrate 203, and the vibration area 230 and the piezoelectric element 211 form a piezoelectric actuator.

The piezoelectric element 211 is formed of sequential stacking of a lower electrode 213, a piezoelectric layer (piezoelectric body) 212, and an upper electrode 214 from a side of the vibration area 230. An insulating film 221 is formed on the piezoelectric element 211.

The lower electrode 213 serving as a common electrode of a plurality of piezoelectric elements 211 is connected to a common electrode power supply wiring pattern 223 through common electrode wiring 215.

The upper electrode 214 serving as an individual electrode of the piezoelectric element 211 is connected to a driving integrated circuit (IC) (driver IC) 240 through individual electrode wiring 216.

The driver IC 240 is mounted on the actuator substrate 220 by flip chip bonding so as to cover an area between the piezoelectric element arrays.

As illustrated in FIG. 1, wiring is extracted from an input/output terminal (I/O), a power supply terminal, and a driving waveform (driving signal) input terminal of the driver IC 240 mounted on the actuator substrate 220 to a connection terminal group 218.

Wiring provided on a wiring member 260 such as a flexible printed circuit (FPC) and a flexible flat cable (FFC) is electrically connected to each connection terminal of the connection terminal group 218 by anisotropic conductive film (ACF) connection, solder connection, and wire bonding, and the other end side of the wiring member 260 is connected to a controller arranged on an apparatus body side.

The wiring member 260 is included in the frame member 270 and is extracted from the head through an extracting port 271. Each connection terminal of the connection terminal group 218 is planarly arranged on an end of the actuator substrate 220.

On the actuator substrate 220, the holding substrate 250 on which a recess (vibration chamber) 251 which accommodates the piezoelectric element 211 is formed is provided.

The holding substrate 250 also forms the channel 210A which is a part of the common liquid chamber 210. The holding substrate 250 is joined to a side of the vibration substrate 203 of the actuator substrate 220 with an adhesive.

In the liquid discharge head 200 configured in this manner, when a voltage is applied between the upper electrode 214 and the lower electrode 213 of the piezoelectric element 211 from the driver IC 240, the piezoelectric layer 212 expands in an electrode stacking direction, that is, in an electric field direction, and contracts in a direction parallel to the vibration area 230.

At that time, since a side of the lower electrode 213 is constrained by the vibration area 230, a tensile stress is generated on the side of the lower electrode 213 of the vibration area 230, and the vibration area 230 bends toward the individual liquid chamber 206 to pressurize liquid therein, so that the liquid is discharged from the nozzle 204.

Nozzle Substrate and Cover Member

Figure 5B:
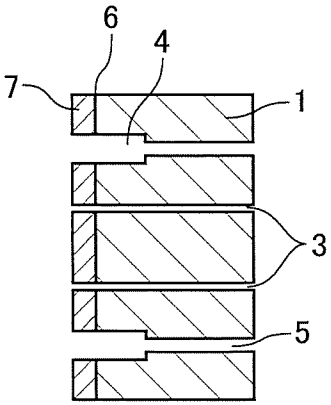
FIGS. 5A and 5B are schematic diagrams illustrating a nozzle substrate according to an embodiment.
Figure 5A:
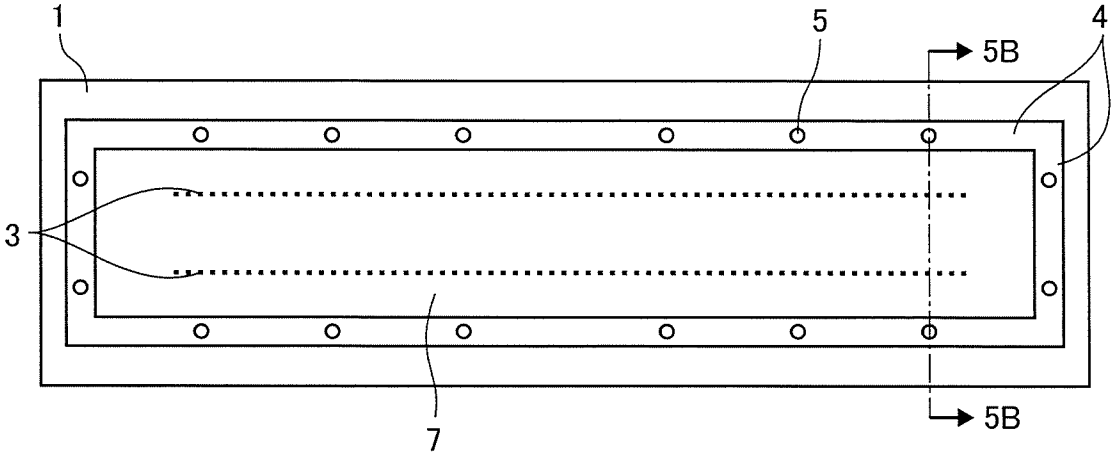
Figure 6B:
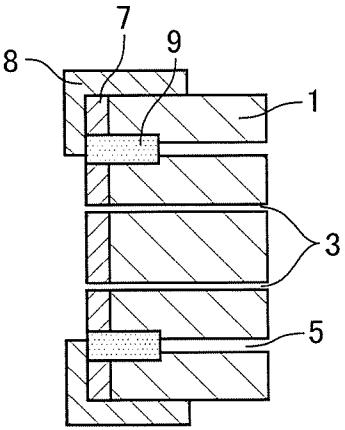
FIGS. 6A and 6B are schematic diagrams illustrating the nozzle substrate to which a cover member according to an embodiment is joined.
Figure 6A:
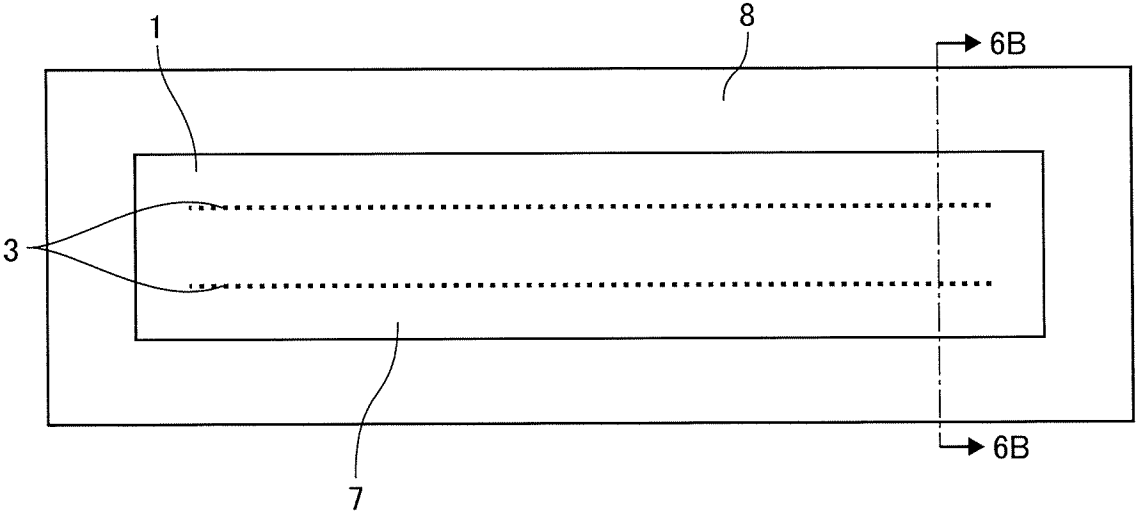

The nozzle substrate and the cover member used in the liquid discharge head of an embodiment are next described. FIGS. 5A and 5B are schematic diagrams illustrating the nozzle substrate according to an embodiment, in which FIG. 5A is a top view and FIG. 5B is a cross-sectional view taken along line 5B-5B in FIG. 5A. FIGS. 6A and 6B are schematic diagrams illustrating the nozzle substrate to which the cover member according to an embodiment is joined, in which FIG. 6A is a top view and FIG. 6B is a cross-sectional view taken along line 6B-6B in FIG. 6A. Herein, a surface on a side on which the liquid is discharged from the nozzle of the nozzle substrate is made a discharge surface (also referred to as "surface on liquid discharge side" or "liquid discharge surface").

An example of a nozzle substrate 1 in which a plurality of nozzles 3 is arrayed to form two arrays is illustrated. The nozzle substrate 1 includes a recess 4 on an outer periphery of the discharge surface. The recess 4 is continuously formed so as to surround an area where the plurality of nozzles 3 is arranged. For example, the recess 4 may be a groove on the discharge surface. On the discharge surface, the recess 4 is formed so as to be lyophilic (for example, hydrophilic) with respect to the liquid discharged from the nozzle 3. In contrast, a non-recessed portion 6 other than the recess 4 has liquid repellency because of a liquid repellent film 7 applied thereto.

The recess 4 is an area (site) to which the adhesive 9 for adhering a cover member 8 is applied. The nozzle substrate 1 and the cover member 8 are adhered to be joined by the adhesive 9 applied to the recess 4. As described above, a water repellent film is not formed on an inner wall of the recess 4. In this manner, the inner wall of the recess 4 is lyophilic to the liquid to be discharged. Therefore, the adhesive is applied to the recess 4. In this manner, the sealing property between the nozzle substrate 1 and the cover member 8 may be secured. Since intrusion of ink into a clearance between the nozzle substrate 1 and the cover member 8 may be prevented, liquid resistance of the liquid discharge head is improved. For example, breakdown of an electric part of the liquid discharge head due to ink adhesion may be reduced. When the nozzle substrate 1 and the cover member 8 are joined to be secured with the adhesive, the applied adhesive 9 enters the recess 4 of the nozzle substrate 1, so that unevenness in thickness of the adhesive 9 is suppressed, and it becomes possible to secure the cover member and the head to position accurately.

The recess 4 preferably has an annular shape (continuous shape). In this manner, the outer periphery is completely sealed by joint with adhesive, so that the clearance between the nozzle substrate 1 and the cover member 8 is eliminated, and the ink intrusion from the clearance may be prevented. It is preferable to form the recess 4 on the outer periphery of the discharge surface. In this manner, the recess 4 is made the area in which the adhesive 9 spreads, and the unevenness in thickness of the adhesive 9 may be suppressed.

The recess 4 is preferably such that, on a surface on which one or more through-holes are formed (bottom of the groove), an area of a portion in which one or more through-holes are not formed is larger than an area of a portion in which one or more through-holes 5 are formed. In this manner, breakability of the nozzle substrate 1 may be reduced. A depth of the recess 4 is preferably one-third (⅓) or less of the thickness of the nozzle substrate 1. In this manner, breakability of the nozzle substrate 1 may be reduced. A width of the recess 4 is preferably one-ninth or more and one-seventh or less (⅑ to ⅐) of a length in a transverse direction of the nozzle substrate 1. In this manner, the area in which the adhesive 9 is applied may be secured, and the breakability of the nozzle substrate 1 may be reduced.

The through-hole 5 may be formed on the recess 4. In this manner, the water repellent film of the recess 4 may be removed from a liquid chamber surface through the through-hole 5 to make the recess 4 lyophilic. Herein, the liquid chamber surface is a surface on a side opposite to the liquid discharge surface of the nozzle substrate 1, the surface to which the channel substrate 202 on which the individual liquid chamber 206 is formed is joined in the embodiment of the liquid discharge head in FIGS. 1 to 4. This is preferable, for example, when the recess 4 is formed as follows. In the liquid discharge head, the liquid repellent film 7 is formed on a surface (discharge surface) on which the cover member 8 is provided of the nozzle substrate 1. At a step of forming the water repellent film on the application surface of the nozzle substrate 1, the liquid repellent film is also formed on the recess 4 at a water repellent film forming step. This is because the water repellent film is formed by dipping of the nozzle substrate 1 into water repellent, and the water repellent film is also formed on the nozzle liquid chamber surface and the inner wall. Originally, the water repellent film is required only in a nozzle formation area of the nozzle substrate 1 (area in which the plurality of nozzles 3 is formed and its surrounding), so that a water repellent film removing step of adhering a protective tape to the nozzle formation area after the water repellent film is formed and removing the water repellent film on the liquid chamber surface and inner wall by vacuum plasma is performed.

By forming the through-hole 5 in the recess 4, it becomes possible to make the recess 4 lyophilic while maintaining water repellency of the non-recessed portion 6 by a process similar to that at the current water repellent film removing step. For example, it is possible to adhere the protective tape to the nozzle formation area on the discharge surface side and perform an ashing process (for example, plasma process) from the opposite surface, thereby making the recess 4 lyophilic. By such circumstances, an example in which the through-hole 5 is formed in the recess 4 is illustrated in FIGS. 5A, 5B, 6A and 6B. Herein, an opening cross-sectional area of the through-hole 5 is made smaller than an opening cross-sectional area of the recess 4. As a result, the plasma is easily diffused in the recess 4 while a decrease in strength of the nozzle substrate 1 due to the formation of the through-hole 5 is made small. However, the nozzle substrate may also include the recess on which the through-hole 5 is not formed. The presence or absence of the through-hole 5 may be selected according to a manufacturing step of the nozzle substrate such as the water repellent film forming step or the water repellent film removing step.

An inner diameter of the through-hole 5 of the recess 4 is preferably 25 to 100 μm (micrometer). In this manner, a lyophilic property of the recess 4 may be secured, and the breakability of the nozzle substrate 1 may be reduced. The number of through-holes 5 on the recess 4 is preferably 20 to 120. In this manner, a lyophilic property of the recess 4 may be secured, and the breakability of the nozzle substrate 1 may be reduced.

The nozzle substrate 1 is preferably made of nickel (Ni). In this manner, since the nozzle substrate 1 may be formed by electroforming, the recess 4 may be easily formed. The nozzle substrate 1 is preferably formed of silicon (Si). In this manner, the nozzle substrate 1 may be formed by a semiconductor process (etching), so that the recess 4 may be easily formed.

FIGS. 5A and 5B illustrate examples of the nozzle substrate 1 in which the liquid repellent film 7 is formed in an area outside the recess 4 (between the recess 4 and the end of the nozzle substrate 1); however, since the cover member 8 overlaps with the area, this is preferably a lyophilic area. In detail, FIGS. 5A and 5B illustrate examples in which the protective tape is adhered to the area other than the recess 4 (nozzle formation area and area outside the recess 4) to make the recess 4 lyophilic, but it is preferable to adhere the protective tape to the nozzle formation area and perform the water repellent film removing step of removing the water repellent film. In this manner, the adhesive 9 overflowing from the recess 4 may form an adhesive layer in the lyophilic area. As a result, an effect of making the joint to the cover member 8 stronger by the formed adhesive layer may be expected.

The through-hole 5 on the recess 4 may also serve as follows in addition to the function described above. For example, a liquid chamber substrate (for example, the actuator substrate 220 in FIG. 1 or the channel substrate 202 in FIG. 2) on which the individual channels are formed is joined to an upper part of the nozzle substrate 1 with an adhesive. The surplus of the adhesive enters the through-hole 5 on the recess 4 of the nozzle substrate 1, so that this may serve as an anchor to strengthen the joint between the nozzle substrate 1 and the liquid chamber substrate.

Another Example of Liquid Discharge Head

Figure 7:
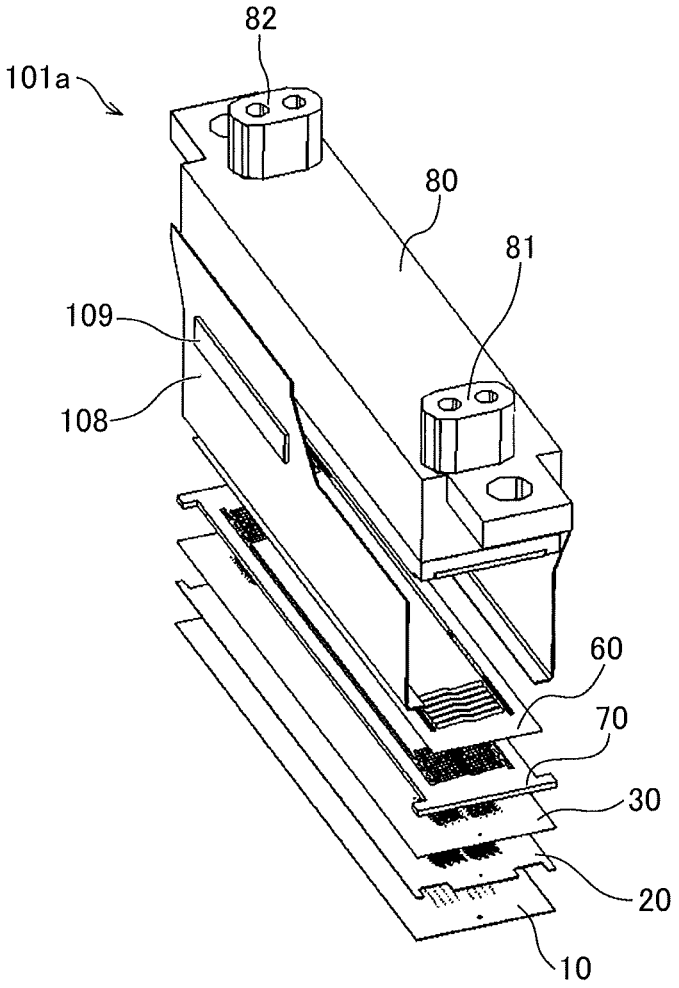
FIG. 7 is an exploded perspective view of another example of the liquid discharge head.
Figure 8:
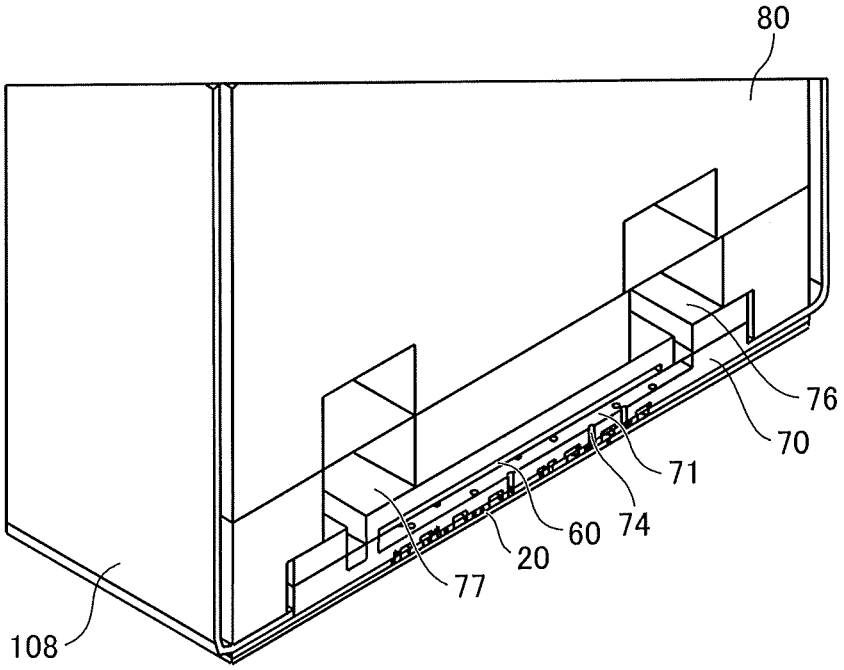
FIG. 8 is a cross-sectional perspective view of the same.
Figure 9:
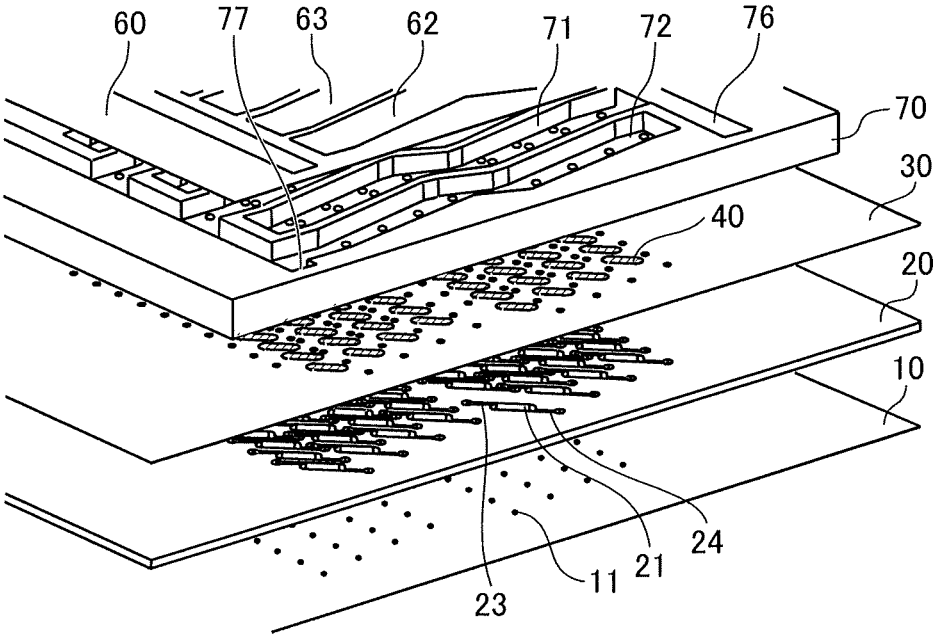
FIG. 9 is an exploded perspective view of the same except a frame member.
Figure 10:
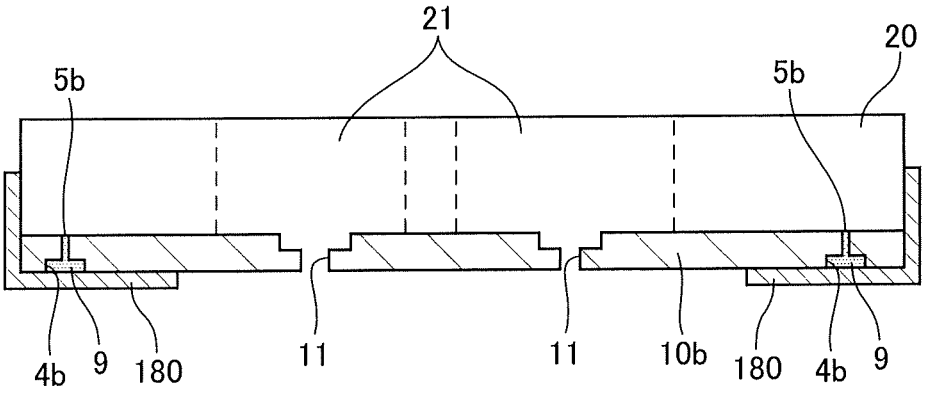
FIG. 10 is a schematic diagram for describing a substantial part of a configuration example in which the nozzle substrate and the cover member of an embodiment are applied to the liquid discharge head in FIG. 7.

Next, another example of the liquid discharge head is schematically described with reference to FIGS. 7 to 9. FIG. 7 is an exploded perspective view of another example of the liquid discharge head, and FIG. 8 is a cross-sectional perspective view of the same. FIG. 9 is an exploded perspective view of the same except the frame member. FIG. 10 is a schematic diagram for describing a substantial part of a configuration example in which the nozzle substrate and the cover member of an embodiment are applied to the liquid discharge head in FIG. 7.

A liquid discharge head 101*a* includes a nozzle substrate 10, an individual channel substrate 20, a vibration substrate 30, a common channel 70, a damper member 60, a frame member 80, and a substrate (flexible wiring substrate) 108 on which a driving circuit 109 is mounted. The individual channel substrate 20 and the vibration substrate 30 form an actuator substrate. The frame member 80 forms a housing.

The nozzle substrate 10 includes a plurality of nozzles 11 for discharging liquid. A plurality of individual liquid chambers 21 communicated with the plurality of nozzles 11, respectively, a plurality of supply-side individual channels 23 communicated with the plurality of individual liquid chambers 21, respectively, and a plurality of recovery-side individual channels 24 communicated with the plurality of individual liquid chambers 21, respectively, are formed on the individual channel substrate 20.

The vibration substrate 30 forms a vibration substrate which is a deformable wall surface of the individual liquid chamber 21, and a piezoelectric element 40 is integrally provided on the vibration substrate 30. The piezoelectric element 40 is a pressure generator which deforms the vibration substrate 30 to pressurize liquid in the individual liquid chamber 21.

The individual channel substrate 20 and the vibration substrate 30 are not limited to be separate members. For example, the individual channel substrate 20 and the vibration substrate 30 may be integrally formed of the same member using a silicon on insulator (SOI) substrate. That is, the SOI substrate obtained by film formation in the order of a silicon oxide film, a silicon layer, and a silicon oxide film on a silicon substrate may be used, and the silicon substrate may be made the individual channel substrate 20, and the silicon oxide film, the silicon layer, and the silicon oxide film may form the vibration substrate 30. In this configuration, a layer configuration of the silicon oxide film, the silicon layer, and the silicon oxide film of the SOI substrate becomes the vibration substrate 30. In this manner, the vibration substrate 30 includes that made of the material of film formation on the surface of the individual channel substrate 20.

The common channel 70 is formed of a plurality of supply-side common channels (common supply channel branches) 71 communicated with two or more individual supply channels, and a plurality of recovery-side common channels (common recovery channel branches) 72 communicated with two or more individual recovery channels alternately formed so as to be adjacent to each other.

The common channel 70 forms one or a plurality of common supply channel main streams 76 communicated with the plurality of supply-side common channels 71 and one or a plurality of common recovery channel main streams 77 communicated with the plurality of recovery-side common channels 72.

The damper member 60 includes a supply-side damper 62 which faces (opposes to) a supply port 74 of the supply-side common channel 71 and a recovery-side damper 63 which faces (opposes to) a recovery port of the recovery-side common channel 72.

A configuration example in which the nozzle substrate and the cover member of an embodiment are applied to the liquid discharge head 101*a* is described with reference to FIG. 10. As described with reference to FIGS. 5A and 5B, a recess 4*b* and a through-hole 5*b* are formed on a nozzle substrate 10*b*. A cover member 180 is adhered to be joined to the nozzle substrate 10*b* with the adhesive 9 applied to the recess 4*b*. By applying the nozzle substrate and the cover member of an embodiment to the liquid discharge head 101*a*, the above-described effect may be obtained.

The two liquid discharge heads described above are examples, and embodiments of the present disclosure are not limited to such a configuration. The liquid discharge head mounted on an ink jet type image forming apparatus may include, for example, the following members.

A plurality of nozzle substrates which discharges ink droplets.

A channel forming member which forms a liquid channel (also referred to as a pressuring chamber, a pressuring liquid chamber, a pressure chamber, a liquid chamber, an ink chamber, and a discharge chamber) communicated with each nozzle substrate.

Electromechanical conversion element such as a pressure generating element which generates energy for pressurizing ink in each channel to discharge ink droplets from the nozzle substrate, or an electrothermal conversion element such as a heater, or an energy generator (actuator element) including an electrostatic force generator such as an electrode.

Head Module

Figure 11:
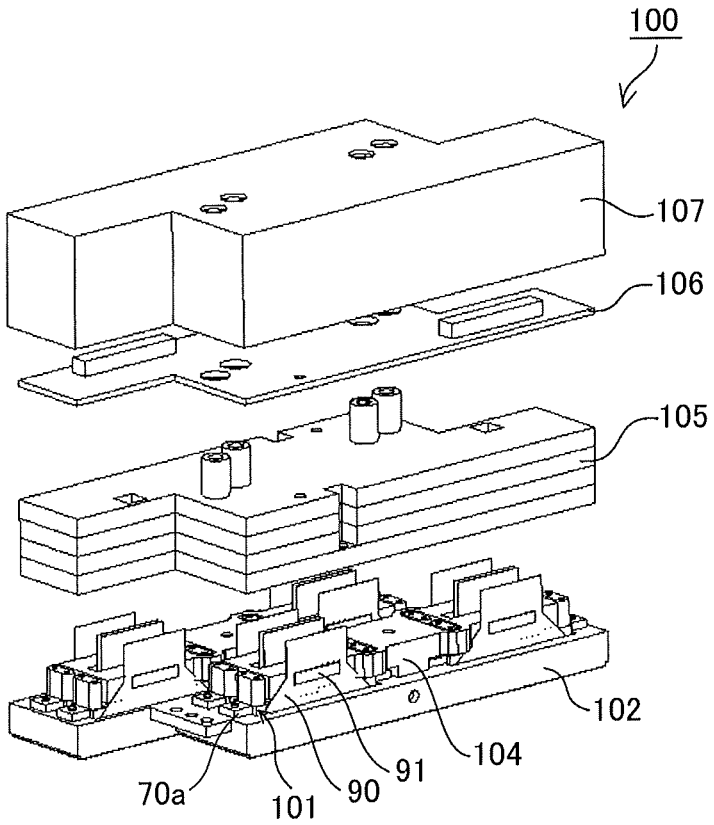
FIG. 11 is an exploded perspective view of a head module according to an embodiment of the present disclosure.
Figure 12:
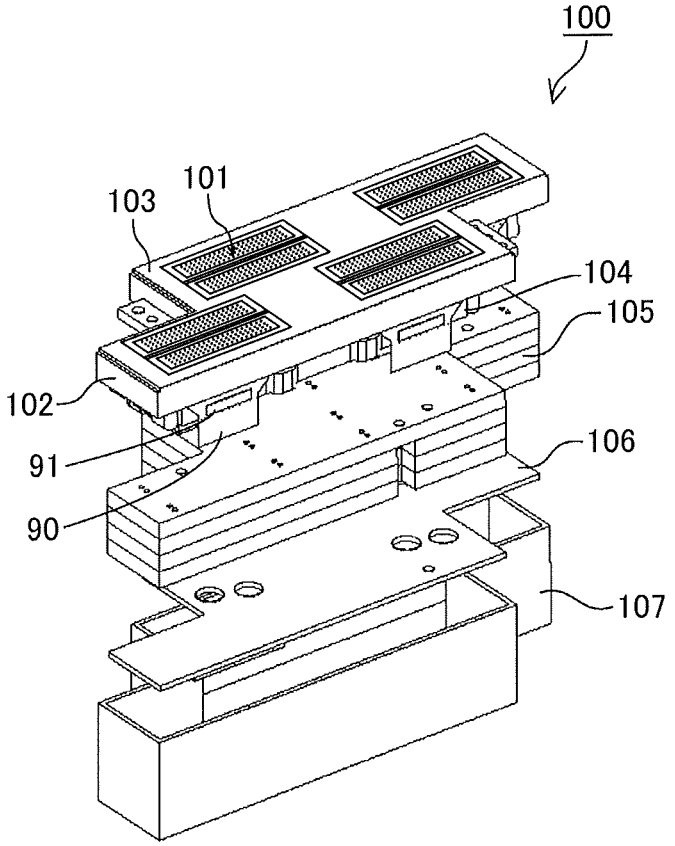
FIG. 12 is an exploded perspective view as seen from a side of a face of a nozzle plate of the head module.
Figure 13:
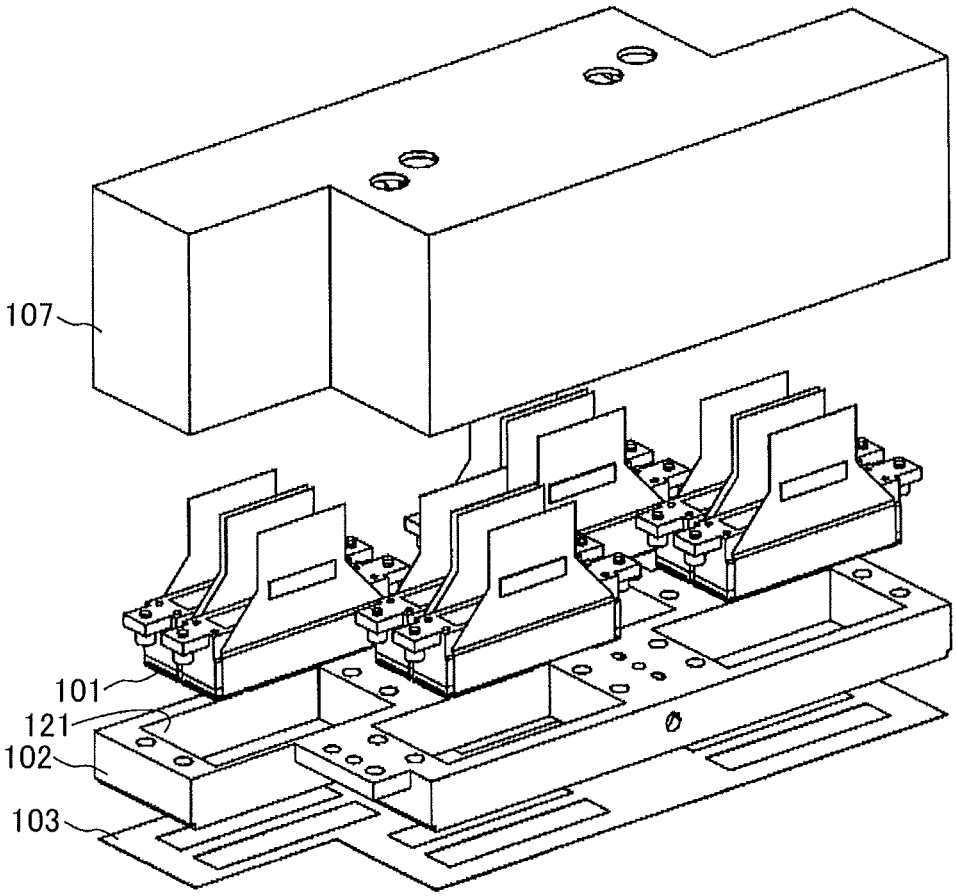
FIG. 13 is an exploded perspective view illustrating a head, a base member, and a cover member of the head module.
Figure 14:
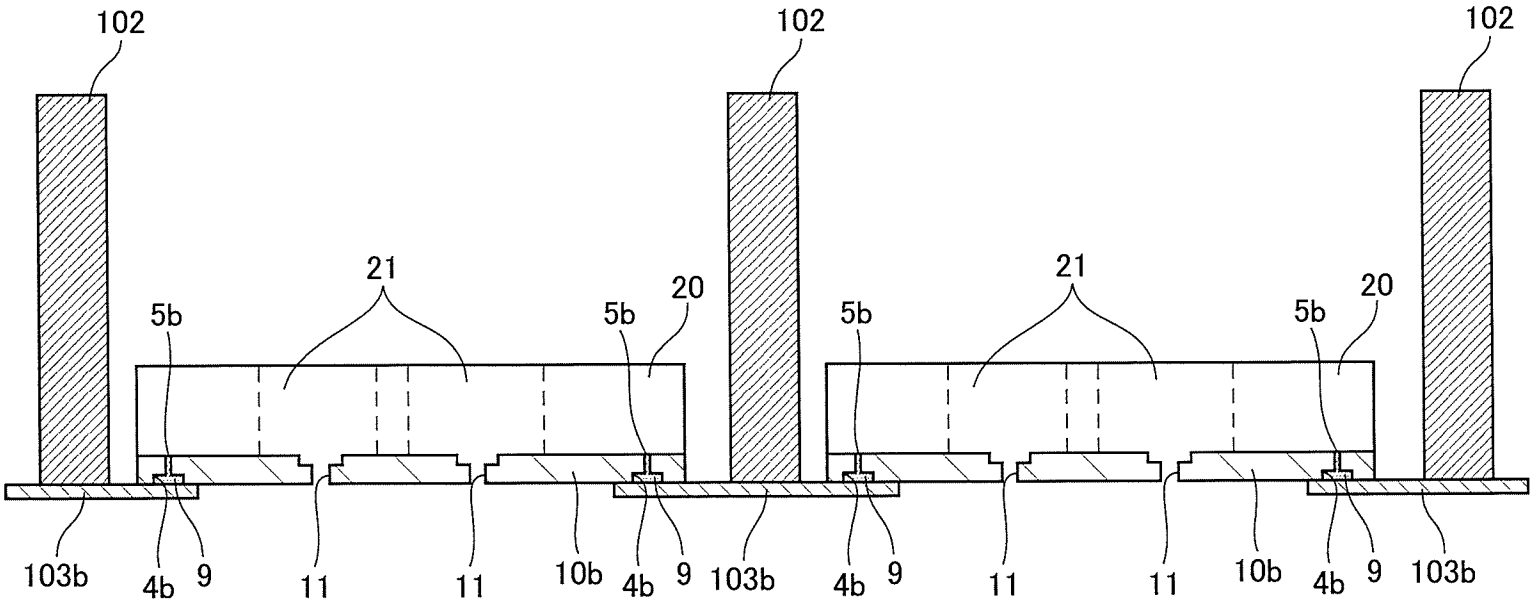
FIG. 14 is a schematic diagram for describing a substantial part of a configuration example in which the nozzle substrate and the cover member of an embodiment are applied to the head module in FIG. 11.

A head module according to an embodiment of the present disclosure is next described with reference to FIGS. 11 to 13. FIG. 11 is an exploded perspective view of the head module, FIG. 12 is an exploded perspective view as seen from a side of a face of a nozzle plate of the head module, and FIG. 13 is an exploded perspective view illustrating a head, a base member, and a cover member of the head module. FIG. 14 is a schematic diagram for describing a substantial part of a configuration example in which the nozzle substrate and the cover member of an embodiment are applied to the head module in FIG. 11.

A head module 100 includes a plurality of heads 101 as liquid discharge heads which discharge liquid, a base member 102, a cover member 103, a heat dissipating member 104, a manifold 105, a printed circuit board (PCB) 106, and a module case 107. Herein, the head 101 is described using a configuration example of the liquid discharge head 101*a* (FIG. 7). The head 101 may also have a configuration in which the cover member 280 is removed from the liquid discharge head 200 (FIG. 1).

As described with reference to FIGS. 7 to 9, the head 101 includes the nozzle substrate 10 on which the nozzle 11 is formed, the individual channel substrate 20 on which the individual liquid chamber 21 communicated with the nozzle 11 is formed, the vibration substrate 30 including the piezoelectric element 40, an intermediate channel substrate 50 stacked on the vibration substrate 30, and the common channel 70 stacked on the intermediate channel substrate 50.

The printed circuit board 106 is connected to the piezoelectric element 40 of the head 101 via a flexible wiring member 90, and a driver IC (driving circuit) 91 is mounted on the flexible wiring member 90.

In this embodiment, a plurality of heads 101 is attached to the base member 102 at intervals. The head 101 is attached to the base member 102 by insertion of the head 101 into an opening 121 provided on the base member 102 and joint and securing of a peripheral area of the nozzle substrate 10 of the head 101 to the cover member 103 joined to be secured to the base member 102. A flange 70*a* provided outside the common channel 70 of the head 101 is joined to be secured to the base member 102.

A securing structure of the head 101 and the base member 102 is not limited, and adhesion, caulking, and screwing may be used.

A configuration example in which the nozzle substrate and the cover member of an embodiment are applied to the head module 100 is described with reference to FIG. 14. The head module includes at least a plurality of nozzle substrates 10*b* and is joined to a cover member 103*b*. The recess 4*b* and the through-hole 5*b* are formed on the nozzle substrate 10*b*. The cover member 103*b* is formed so as to expose an area in which the plurality of nozzles 11 on each nozzle substrate 10*b* is arranged. The cover member 103*b* is adhered to be joined to the plurality of nozzle substrates 10*b* with the adhesive 9 applied to the recess 4*b*.

Apparatus which Discharges Liquid

Figure 15:
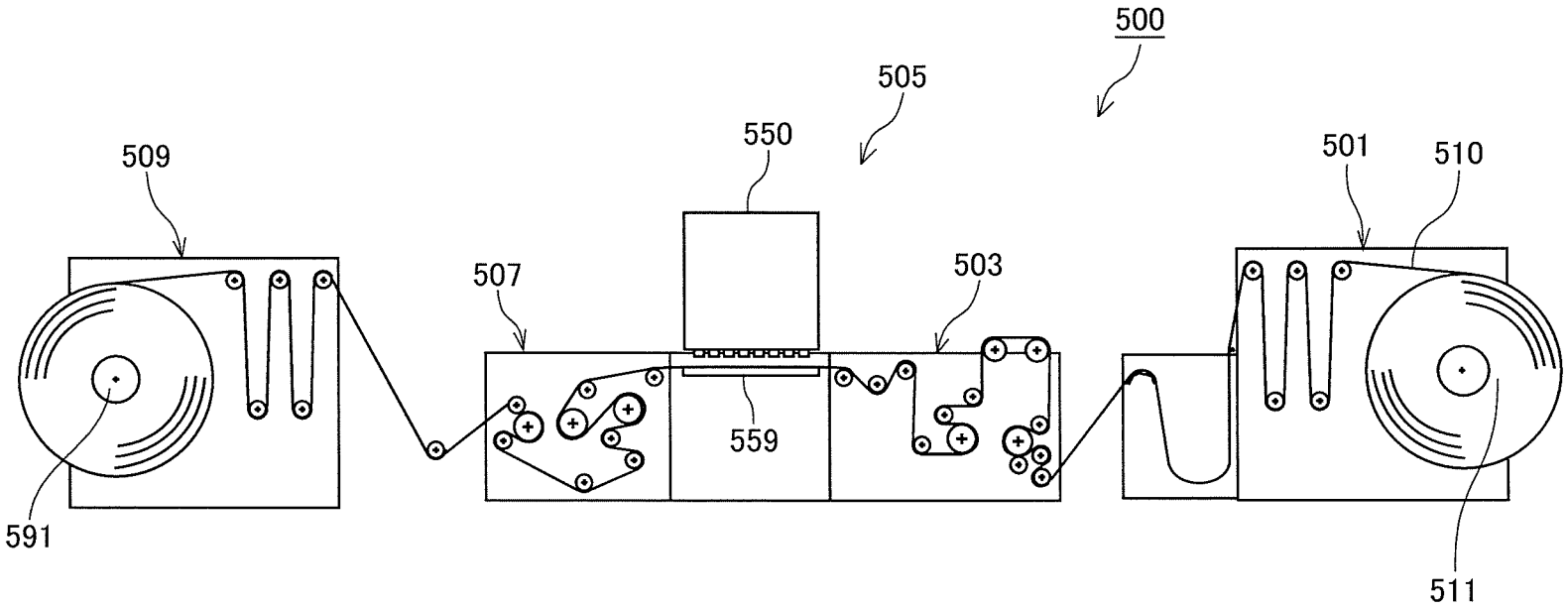
FIG. 15 is a schematic diagram of an example of an apparatus which discharges liquid according to an embodiment of the present disclosure.
Figure 16:
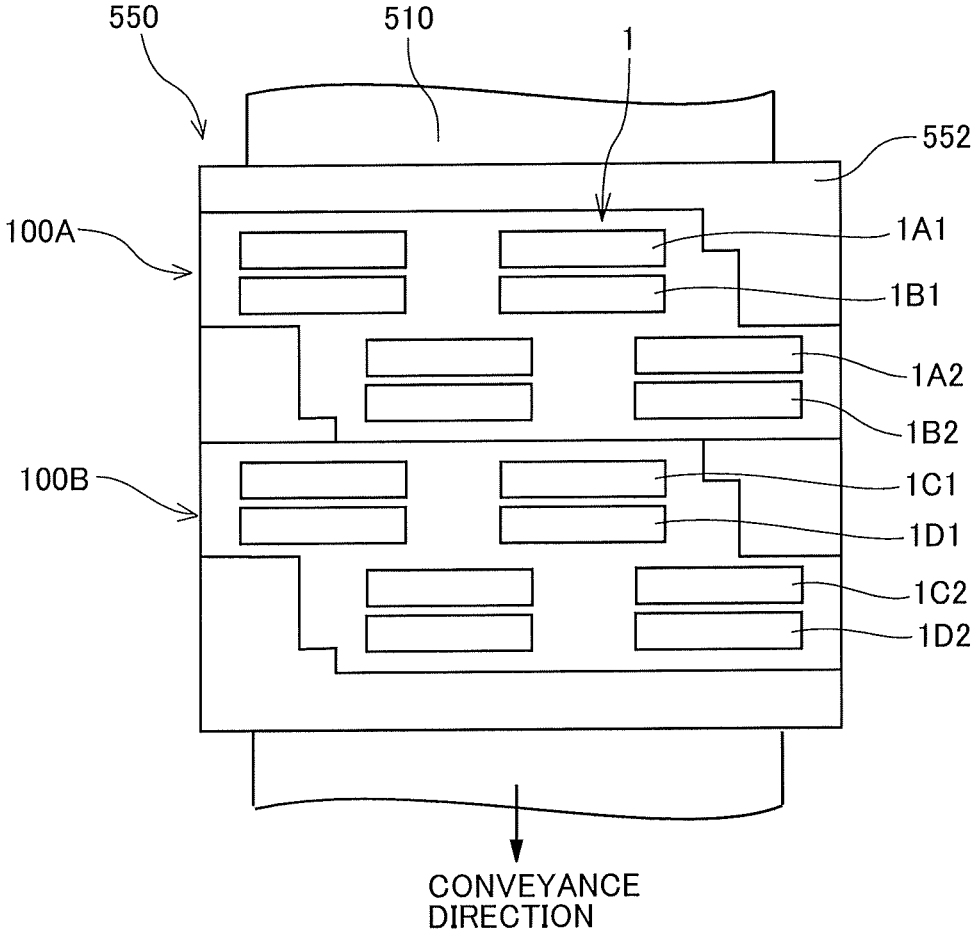
FIG. 16 is a plan view of an example of a head unit of the apparatus.

Next, an example of an apparatus which discharges liquid according to an embodiment of the present disclosure is described with reference to FIGS. 15 and 16. FIG. 15 is a schematic diagram of the apparatus, and FIG. 16 is a plan view of an example of a head unit of the apparatus.

A printing apparatus 500, which is an apparatus which discharges liquid, includes a carry-in means 501 for carrying in a continuous body 510 such as a continuous form or continuous sheets, a guiding/conveying means 503 for guiding to convey the continuous body 510 carried in from the carry-in means 501 to a printer 505, the printer 505 for printing to discharge liquid to the continuous body 510 to form an image, a dryer 507 for drying the continuous body 510, and a carry-out means 509 for carrying out the continuous body 510.

The continuous body 510 is sent out from an original winding roller 511 of the carry-in means 501, guided to be conveyed by respective rollers of the carry-in means 501, the guiding/conveying means 503, the dryer 507, and the carry-out means 509 to be wound up by a winding-up roller 591 of the carry-out means 509.

The continuous body 510 is conveyed on a conveyance guide member 559 so as to face a head unit 550 in the printer 505, and the image is printed by the liquid discharged from the head unit 550.

Herein, the head unit 550 includes two head modules 100A and 100B according to the present disclosure on a common base 552 as illustrated in FIG. 16.

Assuming that an arranging direction of the heads 101 in a direction orthogonal to a conveyance direction of the head module 100 is a head array direction, liquid of the same color is discharged by head arrays 1A1 and 1A2 of a head module 100A. Similarly, head arrays 1B1 and 1B2 of the head module 100A are made a group, head arrays 1C1 and 1C2 of a head module 100B are made a group, and head arrays 1D1 and 1D2 are made a group, and they discharge liquids of required colors.

The head module according to an embodiment of the present disclosure may be integrated with a functional part and a mechanism to form a liquid discharge unit. For example, the head module may be combined with at least one of a head tank, a carriage, a supply mechanism, a maintenance/recovery mechanism, a main scanning movement mechanism, and a configuration of a liquid circulating apparatus.

Examples of integrating herein include, for example, securing of the head module and the functional part and mechanism by fastening, adhesion, or engaging, and holding of one so as to be movable with respect to the other. The head module and the functional part and mechanism may be detachably attached to each other.

The "apparatus which discharges liquid" in the present disclosure includes an apparatus which includes the head module or the liquid discharge unit and drives the liquid discharge head to discharge liquid. Examples of the apparatus which discharges liquid include not only an apparatus capable of discharging the liquid to a material to which the liquid may adhere but also an apparatus which discharges the liquid toward gas or into liquid.

The "apparatus which discharges liquid" may include a means relating to feeding, conveying, and paper ejection of the material to which the liquid may adhere and also include a pre-processing apparatus and a post-processing apparatus.

Examples of the "apparatus which discharges liquid" include, for example, an image forming apparatus which discharges ink to form an image on paper, and a stereoscopic fabrication apparatus (three-dimensional fabrication apparatus) which discharges fabrication liquid to a powder layer obtained by forming powder into a layer for fabricating a stereoscopic fabrication object (three-dimensional fabrication object).

The "apparatus which discharges liquid" is not limited to an apparatus which visualizes a meaningful image such as a character or a figure by the discharged liquid. For example, an apparatus which forms a meaningless pattern, or an apparatus which fabricates a three-dimensional image are also included.

The "material to which the liquid may adhere" is intended to mean the material to which the liquid may adhere at least temporarily, the material to which the liquid adheres to be fastened or the material to which the liquid adheres to permeate. Specific examples include recording media such as paper, recording paper, recording paper, a film, and cloth, electronic components such as an electronic substrate and a piezoelectric element, and media such as a powder layer, an organ model, and a testing cell; all the materials to which the liquid adheres are included unless limited in particular.

A material of the above-described "material to which liquid may adhere" is not limited as long as liquid may adhere thereto even temporarily such as paper, thread, fiber, fabric, leather, metal, plastic, glass, wood and ceramics.

The "apparatus which discharges liquid" includes an apparatus in which the liquid discharge head and the material to which the liquid may adhere relatively move; however, this is not limited to such an apparatus. Specific examples include a serial type apparatus which moves the liquid discharge head, and a line type apparatus which does not move the liquid discharge head.

The "apparatus which discharges liquid" also includes a treatment liquid applying apparatus which discharges treatment liquid onto paper in order to apply the treatment liquid to a surface of the paper for the purpose of modifying the surface of the paper, and an injection granulation apparatus which injects composition liquid obtained by dispersing row materials in a solution through a nozzle to granulate fine particles of the raw material.

The discharged liquid is not limited in particular as long as this has viscosity and surface tension such that this may be discharged from the head, but the viscosity is preferably 30 mPa·s or less at room temperature under a normal pressure, or by heating and cooling. More specifically, this includes solutions, suspensions, and emulsions including solvents such as water and organic solvents, colorants such as dyes and pigments, functional materials such as polymerizable compounds, resins, and surfactants, biocompatible materials such as deoxyribonucleic acid (DNA), amino acids, proteins, and calcium, edible materials such as natural pigments; they may be used as, for example, inkjet inks, surface treatment liquids, forming liquids of components of electronic elements and light emitting elements, and electronic circuit resist patterns, and three-dimensional fabricating material liquids.

As energy generation sources which discharge liquid, those using piezoelectric actuators (stacked piezoelectric element and thin film piezoelectric element), thermal actuators using electrothermal transduction elements such as heating resistors, electrostatic actuators formed of vibration substrates and counter electrodes are included.

The terms "image formation", "recording", "printing", and "fabrication" used in this specification are synonyms.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge head, comprising:

a nozzle substrate including:

a liquid discharge surface;

a plurality of nozzles arranged in a nozzle arrangement area on the liquid discharge surface and configured to discharge liquid from the liquid discharge surface; and a continuous recess surrounding the nozzle arrangement area on the liquid discharge surface, wherein the recess is communicated with a through-hole penetrating the nozzle substrate; and a cover member joined to the nozzle substrate with the nozzle arrangement area being exposed, wherein the nozzle arrangement area has a liquid repellency with respect to the liquid, an inside of the recess is lyophilic to the liquid and is provided with an adhesive, and the nozzle substrate is joined to the cover member with the adhesive.

2. The liquid discharge head according to claim 1, wherein an opening cross-sectional area of the through-hole is smaller than an opening cross-sectional area of the recess.

3. The liquid discharge head according to claim 1, wherein, in the recess, an area in which the through-hole is not formed is larger than an area in which the through-hole is formed on a surface on which the through-hole is formed.

4. The liquid discharge head according to claim 1, wherein a diameter of the through-hole is 25 micrometers or more and 100 micrometers or less.

5. The liquid discharge head according to claim 1, further comprising: a liquid chamber substrate including a plurality of individual channels communicated with the plurality of nozzles, the liquid chamber substrate joined to an opposite surface of the liquid discharge surface of the nozzle substrate with an adhesive, wherein a part of the adhesive enters the through-hole of the nozzle substrate.

6. The liquid discharge head according to claim 1, wherein a width of the recess is one-ninth or more and one-seventh or less of a length in a transverse direction of the nozzle substrate.

7. A liquid discharge head, comprising:

a nozzle substrate including a liquid discharge surface;

a plurality of nozzles arranged in a nozzle arrangement area on the liquid discharge surface and configured to discharge liquid from the liquid discharge surface; and a continuous recess surrounding the nozzle arrangement area on the liquid discharge surface; and a cover member joined to the nozzle substrate with the nozzle arrangement area being exposed, wherein the nozzle arrangement area has a liquid repellency with respect to the liquid, an inside of the recess is lyophilic to the liquid and is provided with an adhesive, and the nozzle substrate is joined to the cover member with the adhesive, wherein the recess is communicated with a plurality of through-holes penetrating the nozzle substrate, and a number of the plurality of through-holes is 20 or larger and 120 or smaller.

8. A liquid discharge apparatus comprising the liquid discharge head according to claim 1.

9. A head module, comprising:

a plurality of liquid discharge heads including a plurality of nozzle substrates, respectively; and a plurality of cover members joined to the plurality of nozzle substrates, respectively, wherein each nozzle substrate of the plurality of nozzle substrates includes a liquid discharge surface;

a plurality of nozzles arranged in a nozzle arrangement area on the liquid discharge surface and configured to discharge liquid from the liquid discharge surface; and a continuous recess surrounding the nozzle arrangement area on the liquid discharge surface, wherein the recess is communicated with a through-hole penetrating the nozzle substrate, the nozzle arrangement area has a liquid repellency with respect to the liquid, an inside of the recess is lyophilic to the liquid and is provided with an adhesive, and each of the plurality of cover members is joined to one of the plurality of nozzle substrates with the adhesive such that the nozzle arrangement area is exposed.

10. A liquid discharge apparatus comprising the head module according to claim 9.

* * * * *